United States Patent [19]

Sassenberg

[11] Patent Number: 4,856,141

[45] Date of Patent: Aug. 15, 1989

[54] CABINET HINGE WITH COVER IN THE FORM OF AN ELONGATED BELLOWS

[75] Inventor: Gero Sassenberg, High Point, N.C.

[73] Assignee: Karl Lautenschläger GmbH & Co. KG, Fed. Rep. of Germany

[21] Appl. No.: 192,304

[22] Filed: May 10, 1988

[30] Foreign Application Priority Data

May 15, 1987 [DE] Fed. Rep. of Germany ... 8707024[U]

[51] Int. Cl.[4] ..... E05D 11/00

[52] U.S. Cl. ..... 16/250; 16/251

[58] Field of Search ..... 16/223, 225, 250, 251

[56] References Cited

U.S. PATENT DOCUMENTS 2,910,741 11/1959 Dettman ..... 16/250 X

FOREIGN PATENT DOCUMENTS 2721582 11/1978 Fed. Rep. of Germany ..... 16/251
3314641 10/1984 Fed. Rep. of Germany ..... 16/251
1234992 5/1960 France ..... 16/251
2282032 3/1976 France ..... 16/251

*Primary Examiner*—Richard K. Seidel
*Assistant Examiner*—William Scott Andes

[57] ABSTRACT

A cover for cabinet hinges which serves for the hanging of a door ona cabinet and has a carcase-related hinge part which can be adjustably fasterned on the cabinet wall and a door-related hinge part coupled by a linkage mechanism to the carcase-related part and attachable to the inside of the door, which cover conceals at least a portion of the hinge components. The cover has an elongated bellows of elastic material open on its side facing the inside surfaces, which can be elastically lengthened an can flex, at least in the area of the linkage mechanism, around the pivot axis of the hinge. The bellows has at each end a fastening flange which can be releasably attached to the carcase-related hinge part or to the mounting plate of the latter and to the door-related hinge part, respectively.

13 Claims, 1 Drawing Sheet

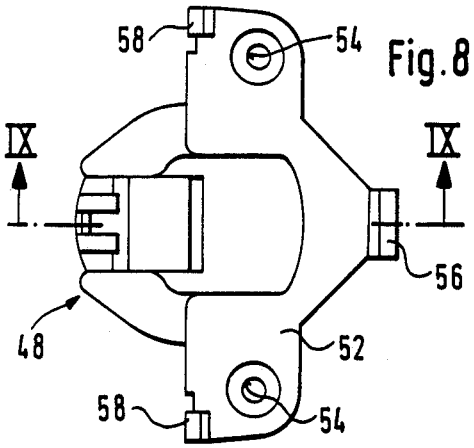
Fig.8
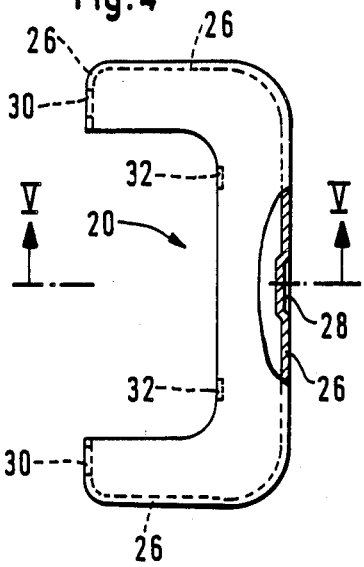
Fig.4
Fig.9
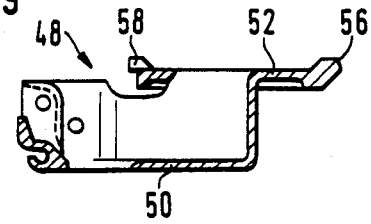
Fig.6
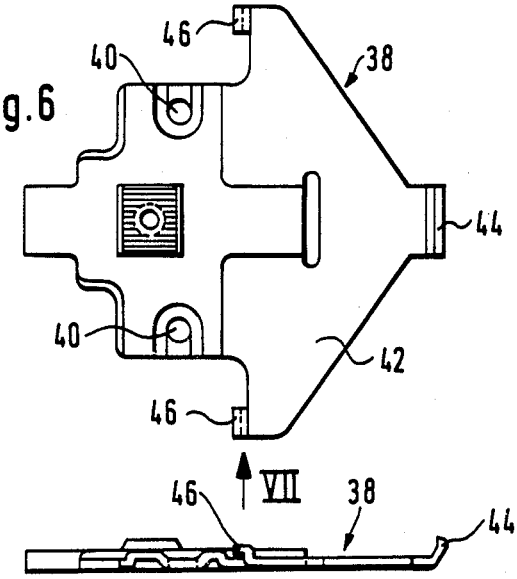
Fig.7
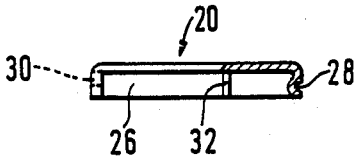
Fig.5

CABINET HINGE WITH COVER IN THE FORM OF AN ELONGATED BELLOWS

BACKGROUND OF THE INVENTION

The invention relates to a covering for cabinet hinges which serve for hanging a door on the carcase of a cabinet and have a carcase-related part which can be adjustably fastened on the carcase of the cabinet and a door-related part which can be fastened on the inside of the door and is coupled pivotingly to the carcase-related part by means of a linkage, and which conceals at least some of the hinge components.

Cabinet hinges of the kind here in question, e.g., the so-called four-pivot hinges, are not visible when the door hung on the cabinet is closed, but they are when the door is opened, in which case the metal parts which then become visible, namely the supporting arm placed on the cabinet wall and forming the carcase-related part, the linkage formed by hinge links, and the cup sunk in a recess on the back of the door but fastened as a rule on the inside face of the door with raised mounting flanges, do not offer a very satisfactory esthetical appearance, inasmuch as the heads of the fastening and adjusting screws holding the supporting arm adjustably on a mounting plate mounted on the cabinet wall and the heads of the fastening screws passing through holes in the fastening flange of the cup are visible. For esthetical reasons alone, it would therefore be desirable if such hinges could be concealed by means of a less noticeable or esthetically more satisfactory covering when the door is open. Furthermore, when the door is closed the linkage and the front part of the supporting arm are retracted into the cup, and it can then happen, especially when the cabinet is very full, that articles of clothing may get caught in the cup and, in the most unfavorable case, are damaged. To prevent clothing from becoming caught, hinges have previously been provided (DE-OS No. 27 21 582) with a resiliently flexible band held at one end on a mounting post on the supporting arm and at the other on the cup; this band stretches tightly over the linkage when the door is opened and bulges outwardly when closed, and at the same time pushes away any clothing in the cabinet that is close to the hinge so that it can no longer be caught. This, however, does not achieve a visually satisfactory concealment of the working part of the hinge.

It is the object of the invention to create a covering for cabinet hinges, especially the modern articulated hinges which are invisible when the door is closed, which will, in a largely inconspicuous manner, cover the hinge parts which are visible when the door is opened and furthermore reliably prevent clothing from becoming caught.

SUMMARY OF THE INVENTION

Setting out from a covering means of the kind described above, this object is achieved according to the invention by the fact that the covering means has an elongated bellows of elastic material, which is open on its inside-wall side, and reaches over the hinge parts projecting above the inside surface of the cabinet wall and of the door, and which can lengthen resiliently and, at least in the area of the linkage, can flex around the hinge pivot axis, and that the bellows has at each of its extremities a fastening flange which can be releasably attached to the carcase-related hinge part or to the mounting plate holding the latter, and to the door-related hinge part.

In a preferred embodiment of the invention the bellows has a substantially channel-shaped cross section, and its marginal edges are shaped such that, when the hinge is open, they lie substantially against the inside surfaces of the cabinet wall and door. The hinge is thus covered on all sides when the door is opened and thus cannot offend the eye, and articles of clothing cannot be caught in the hinge. Since cabinet hinges—when furniture is moved for example—must be accessible for the assembly or disassembly of the cabinet, and on the other hand it can occasionally happen that a hinge has to be readjusted, the adjusting and mounting screws by which the carcase-related hinge part is fastened to the cabinet wall have to be accessible. This is assured by a configuration in which the fastening flanges of matching shape provided at the ends of the bellows project laterally and at the ends from the bellows and in the fastened state rest on associated mounting flanges of the carcase-related hinge part or mounting plate and those of the door-related hinge part, the fastening flanges of the bellows and of the carcase-related hinge part or mounting plate and of the door-related hinge part being made so as to snap together.

In order to achieve a simple and quick, but on the other hand also secure snapping together, it is recommended that there be associated with each fastening flange connection a mounting element overreaching the associated fastening flange of the bellows and the carcase-related hinge part and door-related hinge part, which can snap over projections or into recesses which are provided on opposite boundary sides of the fastening flange of the carcase-related hinge part or the mounting plate and the door-related hinge part.

The mounting element is then preferably configured as an end cap shaped in plan according to the shape of the section of the bellows fastening flange projecting laterally above the bellows having integral marginal strips fitted around the margins of the overlying fastening flange of the bellows and of the carcase-related hinge part or the mounting plate and the door-related hinge part, and that indentations or openings cooperating in a complementary manner with the projections or indentations of the fastening flange of the carcase-related hinge part or mounting plate and door-related hinge part be provided in the marginal strips of the end cap.

The end caps are best made from sheet metal by stamping.

To be able to use the same kind of end caps both at the door end and at the carcase end of the bellows it is recommendable to make the fastening flanges provided at the ends of the bellows of the same shape, and to provide projections or indentations at corresponding places on the fastening flanges of the carcase-related hinge part or mounting plate and door-related hinge part.

The bellows are best made integral with their fastening flanges from an elastomeric plastic, for example by the injection-molding process. By coloring the starting material of the plastic, bellows can be manufactured in desired colors to match the associated cabinet surfaces.

BRIEF DESCRIPTION OF THE DRAWINGS

The invention will be further explained in the description that follows of an embodiment, in conjunction with the drawing wherein:

FIG. 4 is a top view of a end cap serving for snap-fastening the fastening flange of the bellows shown in FIGS. 2 and 3 to the corresponding hinge, FIG. 5 is a cross section of the end cap seen in the direction of the arrows 5—5 in FIG. 4, FIG. 6 is a plan view of the bottom of a mounting plate holding the actual carcase-related part of a hinge on the wall of the cabinet and made suitable for snap-fastening to the corresponding fastening flange of the bellows, FIG. 7 is a side view of the bottom of the mounting plate seen in the direction of the arrow 7 in FIG. 6, FIG. 8 is a top plan view of a recess-mounting cup forming the door-related part of a hinge and for snap-fastening to the associated fastening flange of the bellows, and FIG. 9 is a cross section of the cup seen in the direction of the arrows 9—9 in FIG. 8.

DETAILED DESCRIPTION OF A PREFERRED EMBODIMENT

Figure 1:
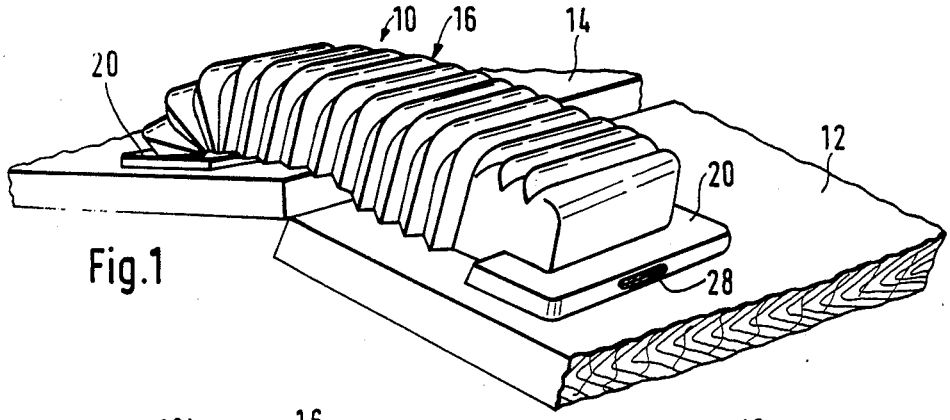
FIG. 1 is a perspective representation of a cover made in the manner of the invention, which conceals a hinge which links a just-opened door to the wall of a cabinet.

FIG. 1 shows the cover made in the manner according to the invention and identified as a whole by the number 10, which completely conceals an articulated hinge, which therefore is not seen in the drawing, either. In the drawing is shown the state of the cover 10 in which the hinge concealed beneath it is holding open the door 14, which is linked to the wall of the cabinet 12. The cover 10 is composed of the open-bottomed bellows 16 represented in FIGS. 2 and 3, which has the fastening flanges 18*a*, 18*b*, integrally formed at its opposite extremities, and two end caps 20 like the one shown in FIGS. 4 and 5, one for each of the fastening flanges 18*a*, 18*b*.

Figure 2:
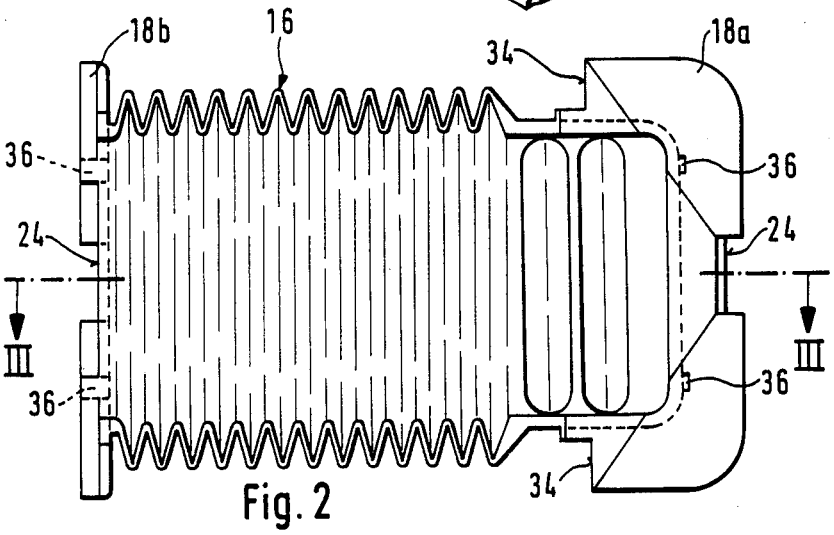
FIG. 2 is a view of the open bottom of the bellows forming the cover shown in FIG. 1, in the position assumed when the hinge is virtually closed.
Figure 3:
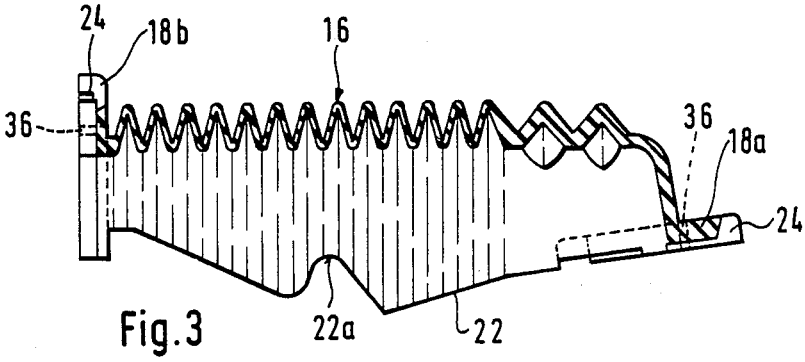
FIG. 3 is a cross section seen in the direction of the arrows III—III in FIG. 2.

In FIGS. 2 and 3 the bellows 16 made of elastomeric plastic is shown in the position corresponding to the nearly closed state of the hinge in which it is removed from the mold, and in which the fastening flanges 18*a*, 18*b*, which are of the same shape and construction, are at the virtual right angle to one another which they assume in the closed position. The edges 22 defining the open side of the bellows 16, i.e., facing the inner surfaces of the cabinet wall 12 and the door 14, have the shape as seen from one side that can be seen in FIG. 3, which makes it possible for the bellows, upon the opening of a hinge disposed under the bellows 16, e.g., a common four-pivot hinge, of a door hung on the cabinet wall, not only to expand by the drawing apart of the accordion-like folds, but also, preferably in the area of the indentation 22*a*, to flex resiliently relative to its carcase-related hinge part in accordance with the swinging of the door-related part of the hinge.

The fastening flanges 18*a*, 18*b*, formed integrally at the ends of the bellows 16, and of similar configuration as mentioned, project on the sides and on the end facing away from the bellows, beyond the bellows, so that the projecting sections of the fastening flanges therefore are of a U-shape, which is provided on one side of the crossbar of the U with an open indentation 24 whose function will be described below in connection with FIGS. 6 and 7 and FIGS. 8 and 9.

For the releasable fastening of the fastening flanges 18*a*, end cap 20 (FIGS. 4 and 5) stamped from sheet metal and pressed into shape is provided, which has the profile of the sections of the fastening flanges 18*a*, 18*b*, which project beyond the bellows 16, i.e., has a U-shaped profile, but at the same time has a turned-down marginal rim 26 along the outer edges of the limbs of the U and of the crossbar joining them together, which thus covers the outside edges of the associated fastening flange 18*a*, 18*b*.

About in the center of the area of the marginal rim 26 turned down from the surface of the crossbar of the U there is provided an elongated indentation 28 which produces on the inside of the marginal rim a correspondingly projecting elongated catch. In the portions of the marginal rim which run around the free ends of the limbs of the U of the end cap 20, there are formed the gaps 30. Furthermore, on the margin of the crossbar of the U which is not provided with the rim and which faces the bellows, there are also provided two tabs 32 bent down in the same direction as the rim 26 at a lateral distance apart. As it can be seen, when the end cap 20 is in position on a fastening flange 18*a* or 18*b*, the indentation 28 lies in the area of the recess 24 of the associated fastening flange, while the sections of the marginal rim 26 provided with the gaps 30 lie in front of the corresponding shoulders 34 of the fastening flange. The mounting tabs 32 are associated with openings 36 in the fastening flanges which are engaged by the tabs 32 of the end cap 20.

To conceal a hinge the bellows is fastened over it by snapping the end caps 20 onto the door-related hinge part and its supporting-wall-related hinge part, or, as in the case of the embodiment discussed below in connection with FIGS. 6 and 7, onto the mounting plate adjustably holding the supporting-wall-related hinge part. In FIGS. 6 and 7, the bottom part 38, stamped from sheet metal and pressed to shape, of a bipartite, adjustable-height mounting plate is shown, whose general configuration with reference to the mounting of the corresponding upper part (not shown) and its fastening to the wall 12——e.g., by means of screws passing through bores 40—is unimportant in the present connection, and therefore is not further discussed herein. It is important, however, that the mounting plate bottom part 38 is enlarged at its rearward end to form a fastening flange 42 which has in the center of its side facing the cabinet interior a projection 44 pointing upward and backward at an angle, i.e., toward the interior of the cabinet; thus, its surface slanting toward the cabinet interior forms an undercut recess into which the inwardly projecting portion formed by the indentation 28 in the rim 26 of the corresponding end cap 20 can snap, after the projections 46 of the fastening flange 42 projecting laterally and forwardly, i.e., out of the cabinet interior, have first been hung in the associated gaps 30 in the end cap 20. The fastening flange 18*a* of the bellows 16 is fastened to the mounting plate or mounting plate bottom 38, therefore, such that first the end cap 20 is placed on the fastening flange 18*a* and then the end cap is pushed over the fastening flange 42 of the bottom part 38 such that then the projections 46 are engaged in the caps 30. By pressing on the surface of the crossbar of the end cap 20, the indentation 28, with its internally formed projection, is snapped over the undercut, sloping outer side of the projection 44. For disassembly the procedure is reversed by inserting the blade of a screwdriver into the indentation 28 and then prying upward against the inner surface of the cabinet wall 12 until the projecting area formed on the inside by the indentation is released from the projection 44. By pulling out the projections 46 the end cap 20 can then be separated from the bottom 38 of the mounting plate by separating from one another the superimposed fastening flanges 18*a* and 42 of the bellows 16 and bottom 38, respectively.

The bellows 16 is fastened to the door by a snap fastening, similar in principle, of the end cap 20 associated with the fastening flange 18*b* to the door-related part of the hinge shown in FIGS. 8 and 9. The door-related hinge part might have the usual form of a cup 48 fastened in a mortise on the inside of the door, but there is no need to describe its special configuration in detail because it is unimportant in the present connection. It is important, however, that on the upper margin of the actual bowl 50 of the recess-mounted cup 48 a fastening flange 52 projecting on both sides be provided with bores 54 for screwing the fastening flange 52 to the inside of the door, this fastening flange 52 being in turn provided with a central projection 56 disposed at an angle, and thus corresponding to the projection 44 of the mounting plate bottom 38, and with two oppositely pointing lateral projections 58 which thus correspond to the projections 46 of the mounting plate bottom 38. Since the position of the projections 56 and 58 relative to one another and their configuration correspond to the projections 44 and 46 of the mounting plate bottom 38 and also the end cap 20 associated with the fastening flange 18*b* is identical to the end cap 20 associated with the fastening flange 18*a*, it is clear that the installation and removal of the fastening flange 18*b* on the fastening flange 52 of the cup 48 corresponds to the previously described installation and removal of the fastening flange 18*a* on the fastening flange 42 of the mounting plate bottom 38 and therefore does not have to be represented in the drawing.

I claim:

1. In combination: a cabinet hinge comprising a carcase-related hinge part having a flange adjustably fastened on an inside surface of a carcase wall of a cabinet, a door-related hinge part having a flange fastened to an inside surface of a door, a linkage coupling said two parts so as to pivot about a pivot axis, and a cover comprising: an elongated bellows of elastic material, open on one side and overreaching portions of the hinge projecting above the inside surfaces, the bellows having at each of two opposite ends thereof a fastening flange projecting laterally and terminally from the bellows, the bellows having a substantially U-shaped cross section, marginal edges of the bellows formed by free ends of limbs of the U-shaped cross section being shaped such that they lie substantially on the inside surfaces in an open position of the hinge, and means for respectively joining the fastening flange to the flange on the carcase-related hinge part, and to the flange on the door-related hinge part, said joining means including holding elements respectively overreaching the associated fastening flanges of the bellows and of the carcase-related part, and of the door-related hinge part, and snapped to associated holding means provided on opposite boundary sides of the associated fastening flanges, the bellows being stretchable as said hinge parts move apart from each other upon opening of the hinge and, at least in the area of the linkage, being bendable about the pivot axis.

2. A cover according to claim 1, wherein the bellows and the flanges are integral parts made from an elastomeric plastic.

3. The combination according to claim 1, wherein the holding element is an end cap shaped in plan complementary to the shape of the respective fastening flange projecting laterally beyond the bellows, and having integrally formed marginal strips fitted around margins of the superimposed flange of the bellows and of the carcase-related hinge part and of the door-related hinge part, respectively, and gaps and indentations in the marginal strips cooperating complimentarily with the holding means of the flanges on the carcase-related hinge part, and on the door-related hinge part, respectively.

4. The combination according to claim 3, wherein the end caps are stamped and embossed parts of sheet metal.

5. The combination according to claim 1, wherein the fastening flanges are of the same shape, and wherein the holding means on the associated flanges of the carcase-related part and on the door-related hinge part are provided at places corresponding to one another.

6. The combination of claim 1, wherein said holding means are projections.

7. The combination of claim 1, wherein said holding means are indentations.

8. In combination: a cabinet hinge comprising a carcase-related hinge part, a mounting plate connected to said hinge part and having a flange adjustably fastened on an inside surface of a carcase wall of a cabinet, a door-related hinge part having a flange fastened to an inside surface of a door, a linkage coupling said two parts so as to pivot about a pivot axis, and a cover comprising: an elongated bellows of elastic material, open on one side, overreaching portions of the hinge projecting above the inside surfaces, the bellows having at each of two opposite ends thereof a fastening flange projecting laterally and terminally from the bellows, the bellows having a substantially U-shaped cross section, marginal edges of the bellows formed by free ends of limbs of the U-shaped cross section being shaped such that they lie substantially on the inside surfaces in an open position of the hinge, and means for respectively releasably joining the fastening flange to the flange on the mounting plate and to the flange on the door-related hinge part, said joining means including holding elements respectively overreaching the associated fastening flanges of the bellows and of the carcase-related part, and of the door-related hinge part, and snapped to associated holding means provided on opposite boundary sides of the associated fastening flanges, the bellows being stretchable as said hinge parts move apart from each other upon opening of the hinge and, at least in the area of the linkage, being bendable about the pivot axis.

9. The combination according to claim 8, wherein the holding element is an end cap shaped in plan complementary to the shape of the respective fastening flange projecting laterally beyond the bellows, and having integrally formed marginal strips fitted around margins of the superimposed flange of the bellows and of the mounting plate and of the door-related hinge part respectively, and gaps and indentations in the holding marginal strips cooperating complimentarily with the holding means of the flanges on the mounting plate, and on the door-related hinge part, respectively.

10. The combination according to claim 9, wherein the end caps are stamped and embossed parts of sheet metal.

11. The combination according to claim 8, wherein the fastening flanges are of the same shape, and wherein the holding means on the associated flanges of the mounting plate and on the door-related hinge part are likewise provided at places corresponding to one another.

12. The combination of claim 8, wherein said holding means are projections.

13. The combination of claim 8, wherein said holding means are indentations.

* * * * *